US007293657B1

(12) United States Patent
Kelton et al.

(10) Patent No.: US 7,293,657 B1
(45) Date of Patent: Nov. 13, 2007

(54) HYDROCYCLONE AND METHOD FOR LIQUID-SOLID SEPARATION AND CLASSIFICATION

(75) Inventors: Gerald P. Kelton, Tucson, AZ (US); Mark E. Hoyack, Tucson, AZ (US); Timothy J. Olson, Tucson, AZ (US)

(73) Assignee: Krebs International, Tucson, AZ (US)

( * ) Notice: Subject to any disclaimer, the term of this patent is extended or adjusted under 35 U.S.C. 154(b) by 1059 days.

(21) Appl. No.: 09/563,947

(22) Filed: May 2, 2000

(51) Int. Cl.
*B04C 5/00* (2006.01)

(52) U.S. Cl. ..... 209/715; 209/720; 209/722

(58) Field of Classification Search ..... 209/715, 209/720, 722
See application file for complete search history.

(56) References Cited

U.S. PATENT DOCUMENTS

| | | | | | |
|---|---|---|---|---|---|
| 2,338,779 | A | | 1/1944 | Mutch | 209/144 |
| 2,534,702 | A | * | 12/1950 | Driessen | |
| 2,735,547 | A | | 2/1956 | Vissac | 209/211 |
| 3,235,091 | A | | 2/1966 | Doll et al. | 210/512 |
| 3,347,372 | A | | 10/1967 | Bouchillon | 209/211 |
| 3,353,673 | A | * | 11/1967 | Visman | |
| 3,419,152 | A | * | 12/1968 | Ramond | |
| 3,926,787 | A | * | 12/1975 | Gay | 209/3 |
| 4,226,708 | A | * | 10/1980 | McCartney | 209/211 |
| 4,235,363 | A | | 11/1980 | Liller | |
| 4,623,458 | A | * | 11/1986 | Hakola | 210/238 |
| 4,710,299 | A | * | 12/1987 | Prendergast | 210/512.1 |
| 4,721,565 | A | * | 1/1988 | Carroll | 210/251 |
| 4,749,490 | A | * | 6/1988 | Smyth et al. | 210/512.1 |
| 4,842,145 | A | * | 6/1989 | Boadway | 209/144 |
| 5,037,558 | A | | 8/1991 | Kalnins | |
| 5,071,556 | A | * | 12/1991 | Kalnins | 210/512.1 |
| 5,071,557 | A | | 12/1991 | Schubert et al. | |
| 5,110,471 | A | | 5/1992 | Kalnins | |
| 5,133,861 | A | | 7/1992 | Grieve | |
| 5,225,082 | A | * | 7/1993 | Young et al. | 210/512.1 |
| 5,858,237 | A | * | 1/1999 | Hashmi et al. | 210/512.2 |

FOREIGN PATENT DOCUMENTS

| | | | |
|---|---|---|---|
| AU | 82432/87 | | 12/1986 |
| AU | B-82432/87 | * | 6/1988 |
| CA | 2115077 | * | 8/1995 |
| CA | 2115077 | * | 8/1998 |
| GB | 2248198 | | 4/1992 |

* cited by examiner

*Primary Examiner*—Patrick Mackey
*Assistant Examiner*—Mark Hageman
(74) *Attorney, Agent, or Firm*—Edward S. Wright

(57) ABSTRACT

Hydrocyclone and method for separating and classifying solids in which a slurry is introduced into the cylindrical inlet section of the separation chamber of the hydrocyclone so that the slurry rotates about the axis of the chamber, then passes through a first conically tapered section of the separation chamber, and thereafter through a second conically tapered section which has a smaller cone angle than the first conically tapered section. The finer solids are removed through an overflow outlet toward the upper end of the separation chamber, and the coarser solids are removed through an underflow outlet toward the lower end of the chamber.

20 Claims, 6 Drawing Sheets

HYDROCYCLONE AND METHOD FOR LIQUID-SOLID SEPARATION AND CLASSIFICATION

This invention pertains generally to the separation and classification of solid particles and, more particularly, to a hydrocyclone and method for use in liquid-solid separation and classification.

Hydrocyclones heretofore used in liquid-solid separation and classification have had a single cone angle, i.e. a separating chamber with a uniform conical taper. Cone angles of 20 degrees have been used in mining applications for many years, and in the past 10 years or so, cone angles of 10 degrees have been used, particularly for coal.

An example of a prior art hydrocyclone for use in liquid-solid separation and classification is illustrated in FIG. 1. This cyclone has a cylindrical inlet section 11 and a conically tapered section 12 with liners (not shown) which define a separation chamber having a cone angle of 20 degrees. An inlet head 13 is attached to the upper end of the inlet section. This head includes an inlet 14 for the slurry to be processed and an overflow outlet 16 for the finer solids in the slurry. The conically tapered section is consists of two pieces 12*a*, 12*b* which are bolted together to form the section. An apex section 17 connects the lower end of the conically tapered section to an underflow outlet line 18 for the coarser solids. The apex section is internally tapered to provide a match between the diameters of the lower end of the conically tapered section and the outlet line. This discontinuity in the cone angle can disrupt the accelerated flow of the slurry and degrade the performance of the cyclone.

Hydrocyclones with two or more cone angles have heretofore been used for separating oil and other liquids of relatively low specific gravity from water. Such cyclones typically have dual inlets and two or more conically tapered sections with different cone angles, typically a very short 20 degree cone followed by a very long and narrow second cone of about 1 to 2 degrees and then a cylindrical finishing section. Examples of such cyclones are found in U.S. Pat. Nos. 5,037,558, 5,071,556, 5,071,557 and 5,110,471. Although such cyclones are widely used in the separation of liquids, no one of the inventor's knowledge has heretofore suggested their use in the separation and classification of solids.

It is in general an object of the invention to provide a new and improved hydrocyclone and method for liquid-solid separation and classification.

Another object of the invention is to provide a hydrocyclone and method of the above character which provide a significant improvement in performance over conventional hydrocyclones with single cone angles.

These and other objects are achieved in accordance with the invention by providing a hydrocyclone and method for separating and classifying solids in which a slurry is introduced into the cylindrical inlet section of the separation chamber of the hydrocyclone so that the slurry rotates about the axis of the chamber, then passed through a first conically tapered section of the separation chamber, and thereafter through a second conically tapered section which has a smaller cone angle than the first conically tapered section. The finer solids are removed through an overflow outlet at the upper end of the separation chamber, and the coarser solids are removed through an underflow outlet at the lower end of the chamber.

Figure 1:
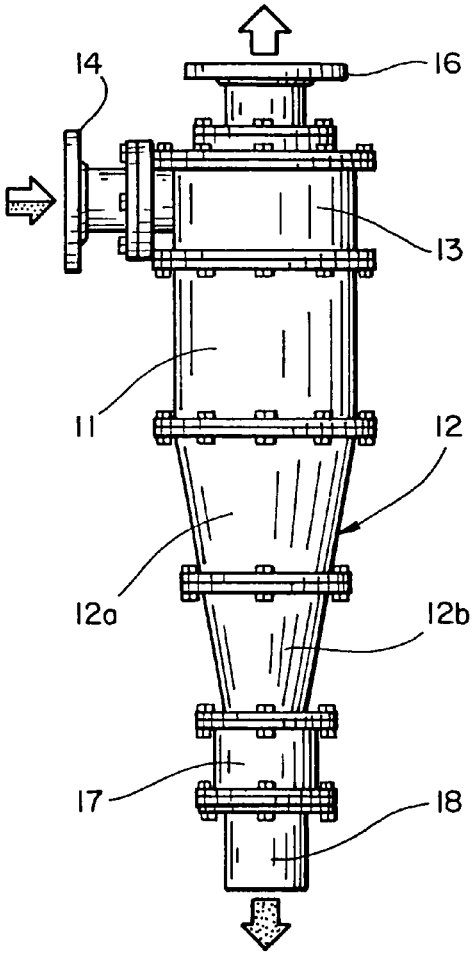
FIG 1 (PRIOR ART)
FIG. 1 is a side elevational view of a prior art hydrocyclone for use in the separation and classification of solids.
Figure 2:
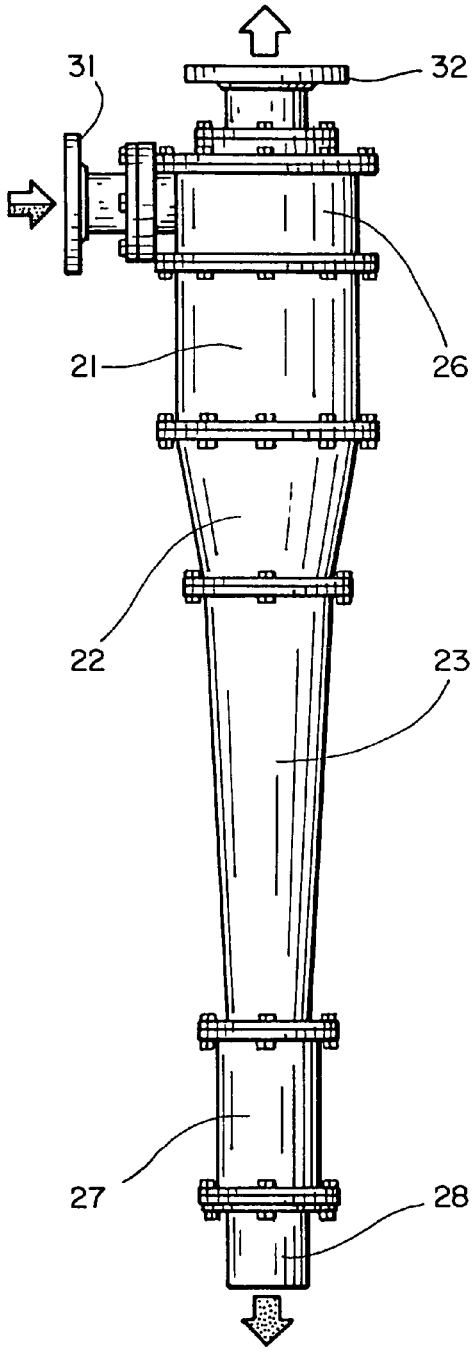
FIG. 2 is a side elevational view of a one embodiment hydrocyclone for use in the separation and classification of solids in accordance with the invention.
Figure 3:
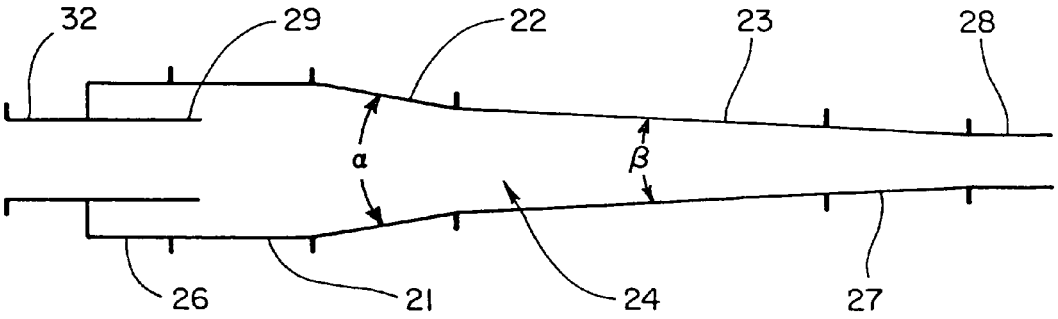
FIG. 3 is a centerline sectional view, somewhat schematic, of the embodiment of FIG. 2, rotated 90 degrees.

Somewhat surprisingly, it has been found that the performance of cyclones in solid separation and classification can be significantly improved by the use of separation chambers with compound cone angles.

As illustrated in FIGS. 2-6, the hydrocyclone has a cylindrical inlet section 21, a first conically tapered section 22, and a second conically tapered section 23 which form an axially elongated separation chamber 24. An inlet head 26 is connected to the upper end of the inlet section, and an apex section 27 connects the lower end of tapered section 23 to a splash skirt 28 at the underflow outlet. A vortex finder 29 extends coaxially within the inlet section for removing finer solids from the separation chamber. The inlet head includes a feed inlet 31 for introducing a slurry into the inlet section of the separation chamber in such manner that it rotates about the axis of the chamber is it passes through the tapered sections. The head also includes an overflow outlet 32 which communicates with the vortex finder for removing the finer solids from the separation chamber.

The cyclone is constructed in a modular form in which the sections are bolted together for ease of maintenance and replacement. Each of the sections has an outer metal housing and a replaceable inner liner made of ceramic, rubber or plastic.

Section 21 is a relatively short cylindrical section, with a length on the order of 0.25 to 2.0 times the diameter of the section. Inlet head 26 is connected to the upper end of the cylindrical section and forms the upper portion of the separation chamber. If desired, the cylindrical section can be formed as part of the inlet head.

The first conically tapered section 22 has a relatively broad cone angle $\alpha$ on the order of 15 to 45 degrees, and the second conically tapered section 23 has a relatively narrow cone angle $\beta$ on the order of 4 to 15 degrees. In one presently preferred embodiment, section 22 has a cone angle of 20 degrees, and section 23 has a cone angle of 6 degrees.

Apex section 27 has an internal conical taper, with the same cone angle as section 23 so that there is no discontinuity between the two sections. The diameter at the upper end of the apex section is equal to the diameter at the lower end of tapered section 23, and the diameter at the lower end of the apex section is equal to, or less than, the diameter of splash skirt 28. Unlike prior art devices, the angle of the apex is matched to the angle of the section above it, and the length of the apex section is chosen so that the diameter at the lower end of the apex matches the diameter of the underflow outlet line.

In the example in which the upper section has a cone angle of 20 degrees and the lower section has a cone angle of 6 degrees, the inlet section of the separating chamber has an internal diameter of 9 11/16 inches, and the separating chamber has an overall length of 63 11/16 inches from the top of the inlet chamber in inlet head 26 to the bottom of the lower tapered chamber at the lower end of apex 27.

The combination of the two cone angles produces a finer and sharper separation than is possible with hydrocyclones having a single cone angle. The first cone angle accelerates the slurry and provides initial separation before the slurry begins to decelerate due to friction from the wall of the cyclone. The accelerated slurry then enters the long, narrow lower cone where it is accelerated even further. The end result is that the slurry is subjected to the highest possible "G" and shear forces in the lower portion of the separation chamber, the area which is the most critical to separation. The separation occurring in that region determines which particles are recovered out of the bottom of the cyclone and which particles reverse direction and move back up in the cyclone where they are either rejected through the vortex finder or redirected back to the wall of the cyclone. It is believed that the combination of the shallow upper cone and the narrow lower cone increases the "G" forces in the cyclone such that the fine material is separated to overflow further up in the lower section of the cyclone, thereby resulting in both a sharper separation and a finer separation.

Figure 4:
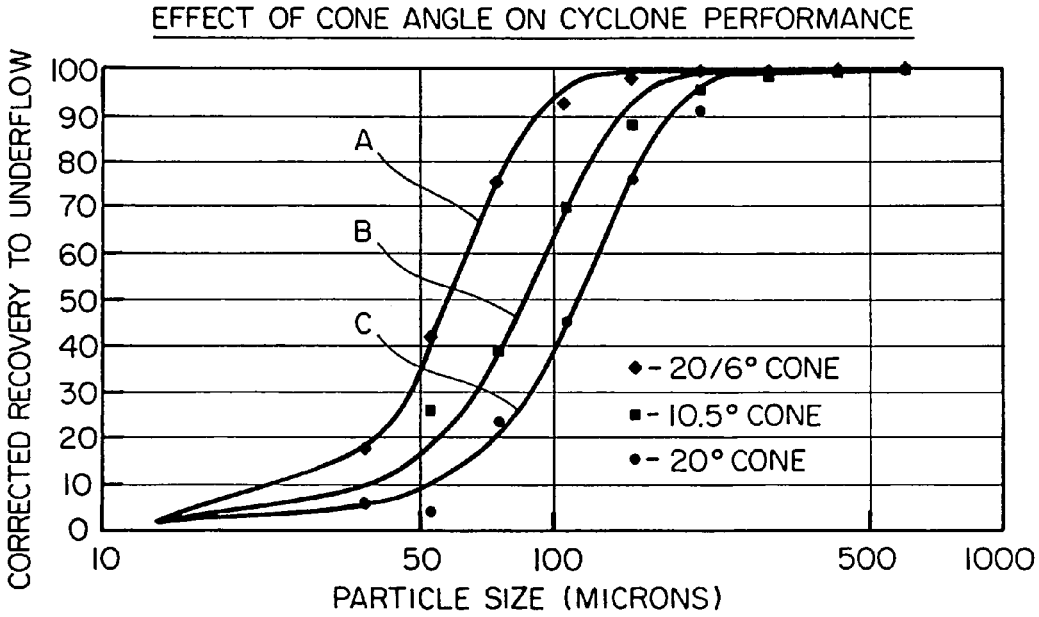
FIG. 4 is a graphical representation showing the effect of cone angle on cyclone performance.

This improvement is illustrated graphically in FIG. 4 where the performance of the hydrocyclone of the invention is compared with that of two prior art devices. In this figure, curve A illustrates the performance of the invention in a cyclone having an upper cone angle of 20 degrees and a lower cone angle of 6 degrees, curve B illustrates the performance of a prior art cyclone having a single cone angle of 10.5 degrees, and curve C illustrates the performance of a prior art cyclone having a single cone angle of 20 degrees. These tests were conducted under substantially equal conditions, with cyclones of similar length and similar operating conditions. Each of the cyclones was operated at a pressure of 20 psi with a slurry consisting of 55-57 percent solids, of which 65-70 percent were 400 mesh and the remainder were 65 mesh. As these curves clearly show, the cyclone with the compound cone angle produced both a significantly lower cut size and a much greater recovery for coarser particles than the prior art devices with the single cone angles.

Figure 5:
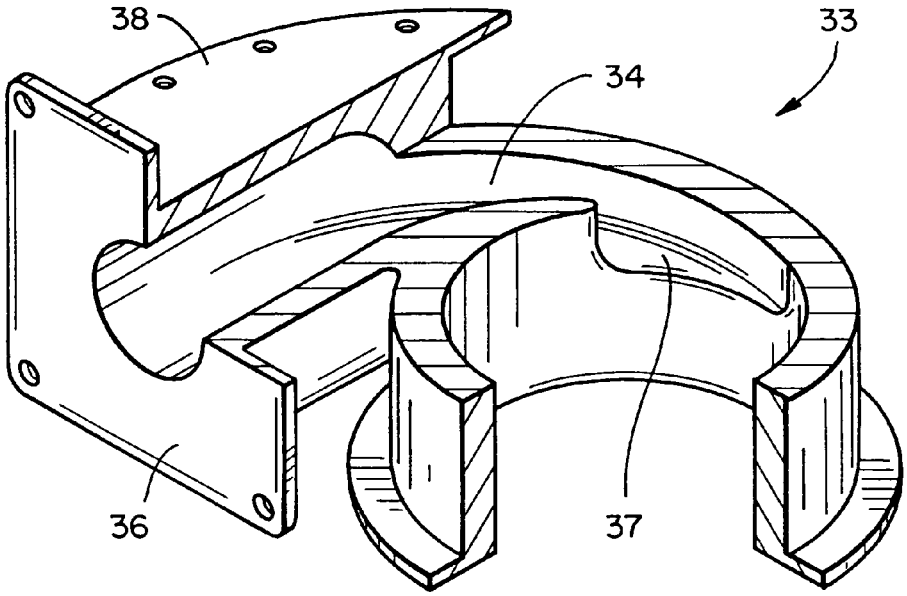
FIG. 5 is an isometric view, partly broken away, of the inlet head liner in the embodiment of FIG. 2.
Figure 6:
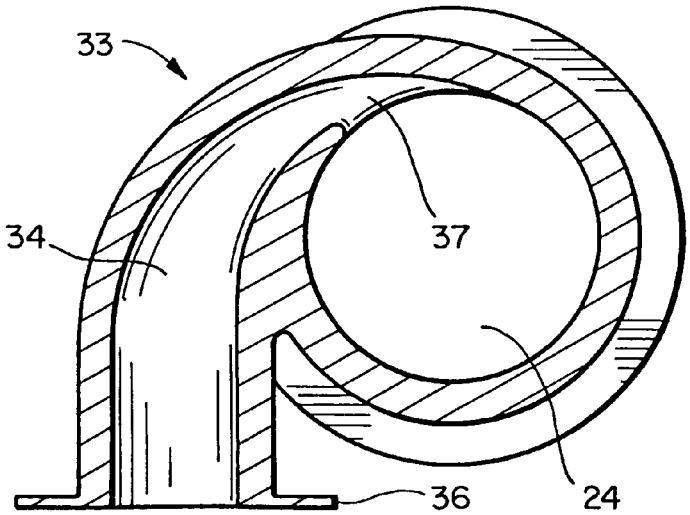
FIG. 6 is a horizontal sectional view of the head liner of FIG. 5.

FIGS. 5 and 6 illustrate a preferred liner 33 for the inlet head. This liner include a passageway 34 which extends along a volute path from an inlet flange 36 to a throat opening 37 in the side wall of the separation chamber. The volute path is downwardly inclined or canted, dropping approximately 1/8 inch between the flange and the throat opening in a cyclone having an internal diameter of 9 11/16 inches. This liner is thicker than liners of the prior art, and includes an integral top cover 38. The corners of the insert are rounded for better slurry flow and wear performance. The combination of the downwardly inclined volute path, the thicker insert, the integral top cover and the rounded corners results in less turbulent incoming slurry that is directed downwardly in the cyclone. This provides a slight increase in capacity and a substantial increase in the wear life of the liner.

Figure 7:
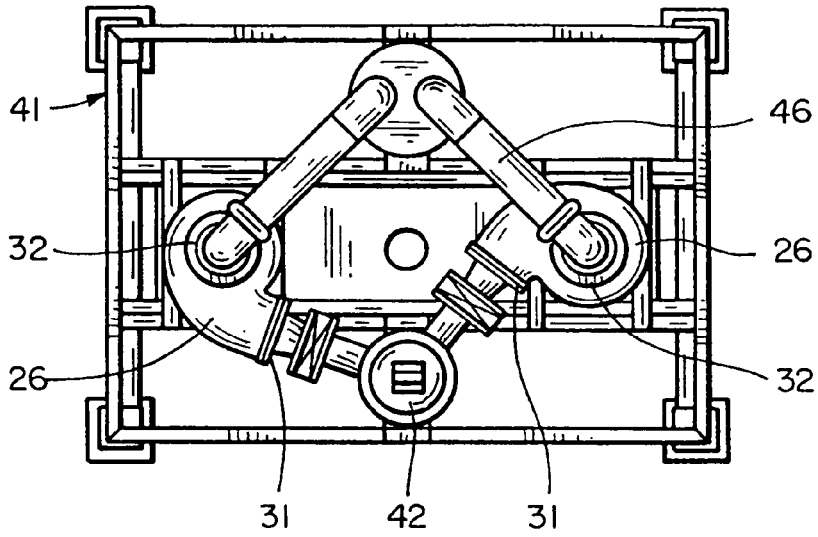
FIG. 7 is a top plan view of one embodiment of a system having two hydrocyclones according to the invention for separating and classifying solids.
Figure 8:
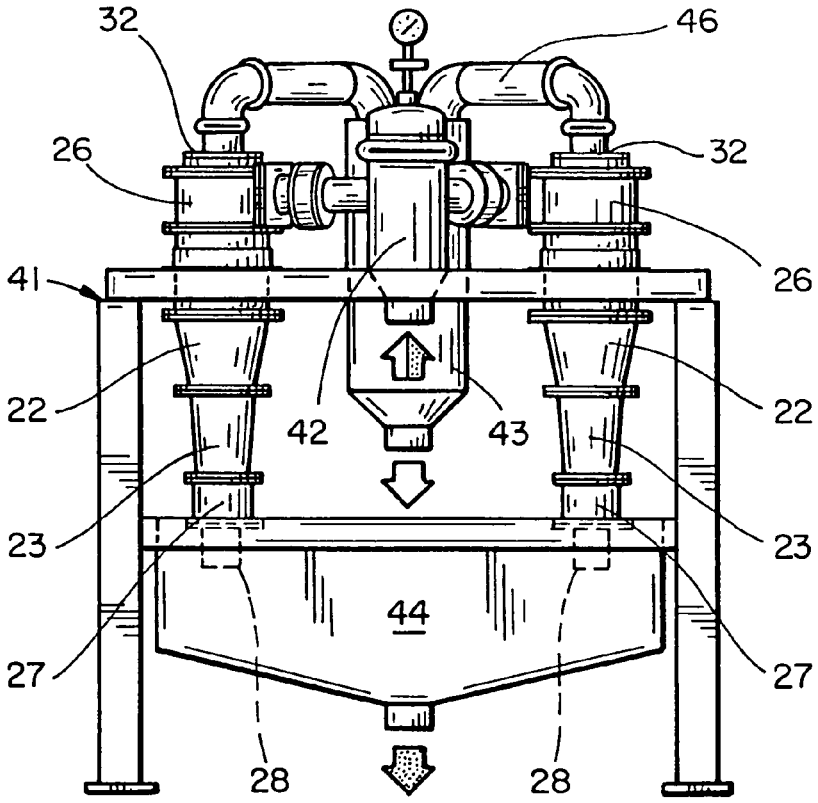
FIG. 8 is a side elevational view of the embodiment of FIG. 7.
Figure 9:
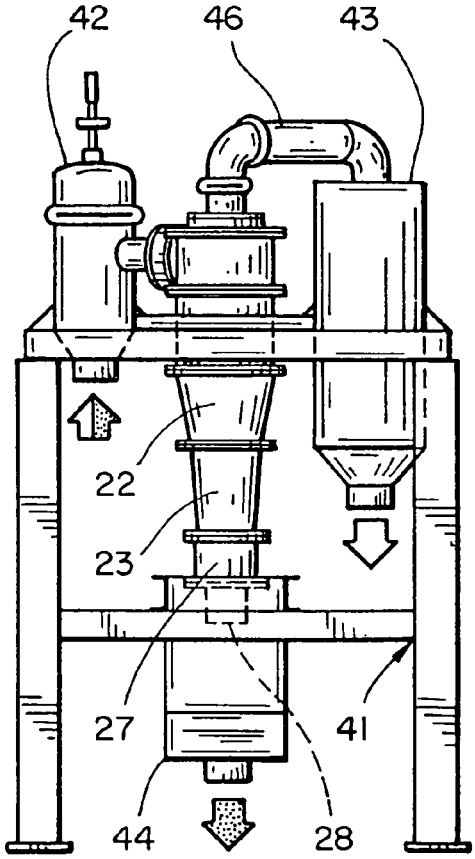
FIG. 9 is an end elevational view of the embodiment of FIG. 7.

FIGS. 7-9 illustrate a system with a pair of hydrocyclones according to the invention. In this system, the hydrocyclones are mounted on a frame 41, along with a slurry pump 42, an overflow launder 43, and an underflow launder 44. The pump is connected to the inlets 31 of the cyclones, and delivers the slurry to the inlets at a suitable rate of flow. Overflow lines 46 extend between overflow outlets 32 and overflow launder 43, and the finer solids are discharged into the overflow launder through these lines. The underflow outlets discharge the coarser solids directly into underflow launder 44, with splash shields 28 preventing the slurry from splashing outside the launder.

Figure 10:
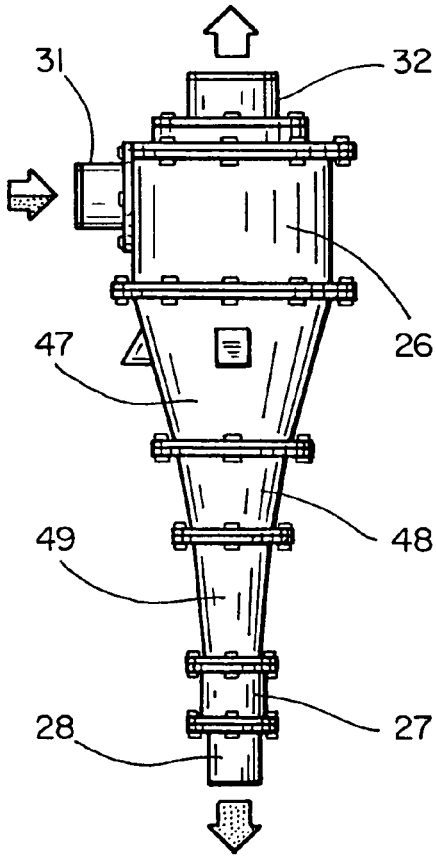
FIG. 10 is a side elevational view of another embodiment of a hydrocyclone according to the invention.

In the embodiment of FIG. 10, the hydrocyclone has three different cone angles. This embodiment is similar to the embodiment of FIG. 2 in that it has an inlet head 26, an apex section 27 and a splash shield 28, with the cylindrical upper section of the separation chamber being formed integrally with the inlet head. This cyclone has a first conically tapered section 47 with a cone angle on the order of 15 to 46 degrees, a second conically tapered section 48 with a cone angle on the order of 6 to 30 degrees, and a third conically tapered section 49 with a cone angle on the order of 2 to 15 degrees. In one presently preferred embodiment, section 47 has a cone angle of 20 degrees, section 48 has a cone angle of 10 degrees, and section 49 has a cone angle of 6 degrees. This cyclone has also been found to provide significantly improved performance, possibly even better than that of cyclones with just two different cone angles. Similar improvement can also be obtained with cyclones having more than three cone angles.

Figure 11:
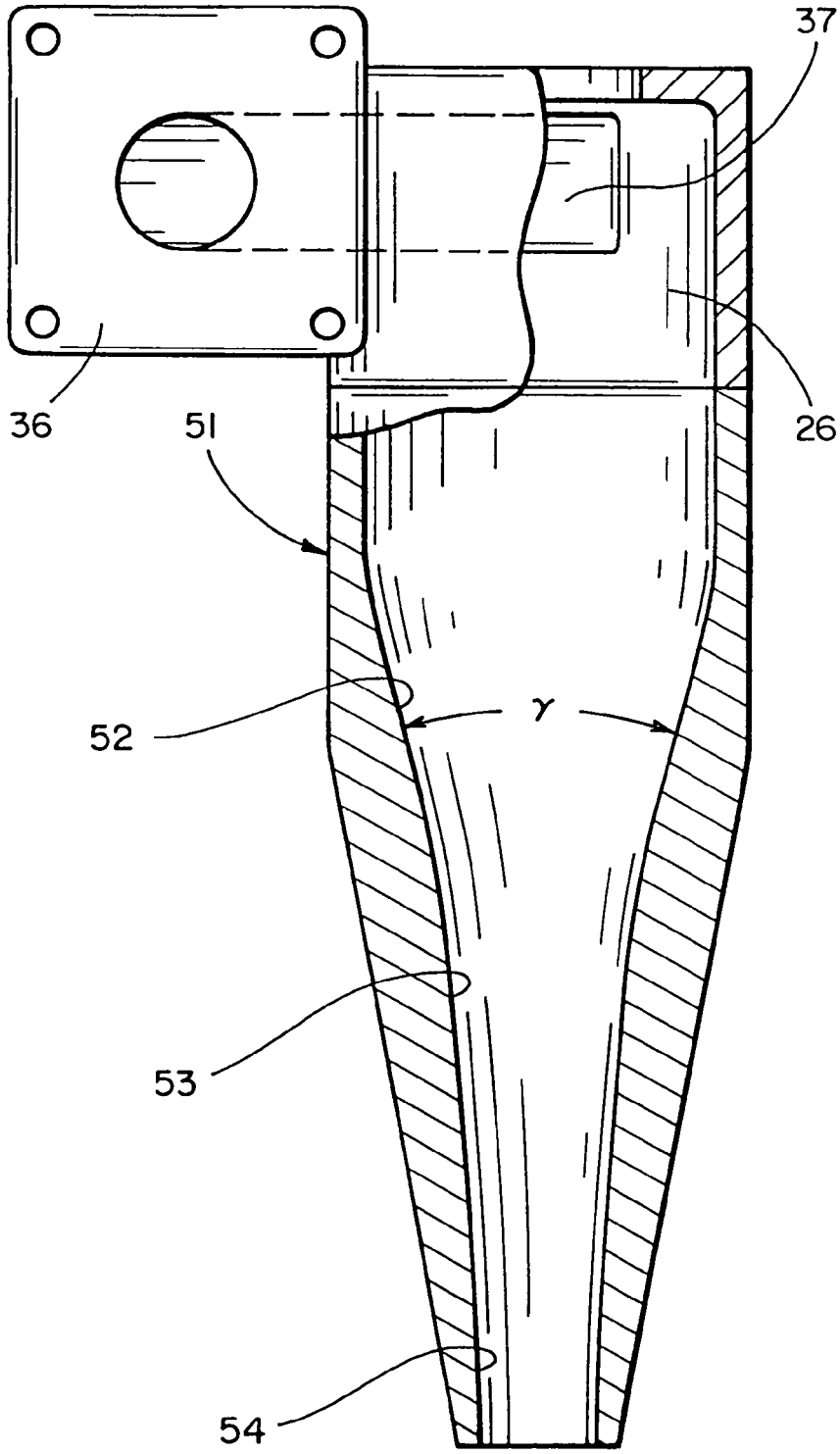
FIG. 11 is a side elevational view, partly broken away, of another embodiment of a hydrocyclone according to the invention.

As illustrated in FIG. 11, the cyclone can also be constructed with a continuously curved side wall 51 rather than having discrete conical sections with side walls inclined at different angles. This wall can be thought of as consisting of an infinite number of conical sections having a cone angle $\gamma$ which decreases toward the lower end of the separation chamber. Thus, in the upper section 52 of the chamber, the angle of the side wall increases from 0 degrees to about 20-30 degrees. In the middle section 53, the angle decreases to about 10-15 degrees, and in the lower section 54, the angle decreases to about 4-10 degrees. With the curved side wall, the improvement in performance is again similar to that of the embodiment of FIG. 2.

The invention has a number of important features and advantages. With the improved inlet combined with the compound cone angles and the apex matched to the lower cone angle, the cyclone of the invention far outperforms prior art devices from the standpoints of capacity, separation, classification and wear life.

It is apparent from the foregoing that a new and improved hydrocyclone and method have been provided. While only certain presently preferred embodiments have been described in detail, as will be apparent to those familiar with the art, certain changes and modifications can be made without departing from the scope of the invention as defined by the following claims.

The invention claimed is:

1. A hydrocyclone for separating and classifying solids, comprising a separation chamber which includes a cylindrical inlet section, a first conically tapered section having a cone angle of 15 to 45 degrees adjacent to the inlet section, and a second conically tapered section extending from the first conically tapered section and having a cone angle of 4 to 15 degrees, the separation chamber and the inlet section having an overall length to diameter ratio no greater than 7:1; an inlet passageway which extends along a volute path toward the inlet section for introducing a slurry of solid particles into the inlet section so that the slurry rotates about the axis of the cyclone and passes through the tapered sections; an overflow outlet for finer solids in the inlet section; and an underflow outlet for receiving coarser solids from the second tapered section.

2. The hydrocyclone of claim 1 wherein the first conically tapered section has a cone angle of 20 degrees, and the second conically tapered section has a cone angle of 6 degrees.

3. The hydrocyclone of claim 1 wherein the inlet passageway is inclined in a downward direction toward the inlet section.

4. The hydrocyclone of claim 1 wherein the separation chamber further includes a conically tapered apex section and a splash skirt at the outlet end of the second conically tapered section, the apex section having the same cone angle as the second tapered section.

5. The hydrocyclone of claim 4 wherein the apex section has a diameter and length such that the diameter at the inlet end of the apex section is equal to the diameter at the outlet end of the second conically tapered section, and the diameter at the outlet end of the apex section is equal to or less than the diameter of the splash skirt.

6. In a method of separating and classifying solids, the steps of: introducing a slurry of solids into the cylindrical inlet section at the upper end of the separation chamber of a hydrocyclone so that the slurry rotates about the axis of the chamber, passing the rotating slurry through a first conically tapered section of the separation chamber which has a cone angle of 15 to 45 degrees, passing the rotating slurry through a second conically tapered section which has a cone angle of 4 to 15 degrees, the separation chamber and the inlet section having an overall length to diameter ratio no greater than 7:1, removing finer solids through an overflow outlet at the upper end of the separation chamber, and removing coarser solids through an underflow outlet at the lower end of the separation chamber.

7. The method of claim 6 wherein the slurry is introduced into the inlet section along a volute path.

8. The method of claim 6 wherein the slurry is directed along a downwardly inclined volute path before being introduced into the inlet section.

9. The method of claim 6 including the step of delivering the coarser solids from the second tapered section through an apex section which is tapered conically and has the same cone angle as the second tapered section.

10. Apparatus for separating and classifying solids, comprising:

a hydrocyclone having a separation chamber with a cylindrical inlet section, a first conically tapered section through a cone angle of 15 to 45 degrees, a second conically tapered section having a cone angle of 4 to 15 degrees, a feed inlet for introducing a slurry of solids into the inlet section of the chamber, an overflow outlet for finer solids, and an underflow outlet for coarser solids;

a source of slurry connected to the feed inlet;

an overflow launder;

a line connected to the overflow outlet for delivering the finer solids from the separation chamber to the overflow launder; and an underflow launder for receiving the coarser solids from the underflow outlet.

11. The apparatus of claim 10 wherein the feed inlet includes a passageway that extends along a volute path toward the inlet section.

12. The apparatus of claim 11 wherein the inlet passageway is inclined in a downward direction.

13. The apparatus of claim 10 wherein the separation chamber further includes an apex section to the second conically tapered section and a splash skirt connected to the apex section, the apex section having the same cone angle as the second tapered section.

14. The apparatus of claim 13 wherein the apex section has a diameter and length such that the diameter at the inlet end of the apex section is equal to the diameter at the outlet end of the second conically tapered section, and the diameter at the outlet end of the apex section is equal to or less than the diameter of the splash skirt.

15. The apparatus of claim 10, wherein the separation chamber has an overall length to diameter ratio no greater than 7:1.

16. Apparatus for separating and classifying solids, comprising:

a hydrocyclone having a separation chamber with a cylindrical inlet section, a first conically tapered section having a cone angle of 15 to 45 degrees, a second conically tapered section having a length of three times the length of the first conically tapered section and cone angle of 4 to 15 degrees, a feed inlet for introducing a slurry of solids into the inlet section of the chamber, an overflow outlet for finer solids, and an underflow outlet for coarser solids;

a source of slurry connected to the feed inlet;

an overflow launder;

a line connected to the overflow outlet for delivering the finer solids from the separation chamber to the overflow launder; and an underflow launder for receiving the coarser solids from the underflow outlet.

17. A hydrocyclone for separating and classifying solids, comprising a separation chamber having inlet and outlet ends with a plurality of conically tapered sections having progressively smaller cone angles between the inlet and outlet ends, the first of the conically tapered sections having a cone angle of 15 to 45 degrees, the second conically tapered section having a cone angle of 6 to 30 degrees, and the third conically tapered section having a cone angle of 2 to 15 degrees, the separation chamber having an overall length to inlet diameter ratio no greater than 7:1, a source of slurry connected to a feed inlet for introducing a slurry of solid particles into the inlet end of the chamber so that the slurry rotates about the axis of the cyclone as it passes through the tapered sections, an overflow outlet for finer solids at the inlet end of the chamber, and an underflow outlet for coarser solids at the outlet end of the chamber.

18. A hydrocyclone for separating and classifying solids, comprising a separation chamber having inlet and outlet ends with a plurality of conically tapered sections having progressively smaller cone angles between the inlet and outlet ends, the first of the conically tapered sections having a cone angle of 20 degrees, the second conically tapered section having a cone angle of 10 degrees, and the third conically tapered section having a cone angle of 6 degrees, means for introducing a slurry of solid particles into the inlet end of the chamber so that the slurry rotates about the axis of the cyclone as it passes through the tapered sections, an overflow outlet for finer solids at the inlet end of the chamber, and an underflow outlet for coarser solids at the outlet end of the chamber.

19. A hydrocyclone for separating and classifying solids, comprising:

a separation chamber having an inlet section in which the angle of the side wall increases from 0 degrees to 20-30 degrees, a central section in which the angle of the side wall decreases from 20-30 degrees to 10-15 degrees, and an outlet section in which the angle of the side wall decreases from 10-15 degrees to 4-10 degrees, the separation chamber having an overall length to diameter ratio no greater than 7:1;

means for introducing a slurry of solid particles into the inlet section of the chamber so that the slurry rotates about the axis of the cyclone as it passes through the chamber;

an overflow outlet for fine solids at the inlet end of the chamber; and an underflow outlet for coarser solids at the outlet end of the chamber.

20. A hydrocyclone for separating and classifying solids, comprising a cylindrical inlet section, a first conically tapered section adjacent to the inlet section, a second conically tapered section extending from the first conically tapered section and having a smaller cone angle than the first conically tapered section, an inlet passageway which extends along a downwardly inclined volute path toward the inlet section for introducing a slurry of solid particles into the inlet section so that the slurry rotates about the axis of the cyclone and passes through the tapered sections, an overflow outlet for finer solids in the inlet section, and an underflow outlet for receiving coarser solids from the second tapered section.

* * * * *